United States Patent [19]

Jackson

[11] 4,044,667

[45] Aug. 30, 1977

[54] MANDRELS FOR SUPPORTING CONTAINERS WITH NEGATIVE AND POSITIVE AIR PRESSURE

[75] Inventor: John Maxwell Jackson, Potters Bar, England

[73] Assignee: Chromax Limited, Perrywood Worcester, England

[21] Appl. No.: 549,819

[22] Filed: Feb. 13, 1975

[30] Foreign Application Priority Data

Feb. 13, 1974 United Kingdom ..... 6620/74

[51] Int. Cl.[2] ..... B41F 17/28

[52] U.S. Cl. ..... 101/38 R; 101/37

[58] Field of Search ..... 101/38 R, 38 A, 39, 101/40, 407 R, 126, 407 A; 302/2 R; 269/21; 279/3; 93/36.1, 36.2, 39.2, 39.3, 39 C

[56] References Cited

U.S. PATENT DOCUMENTS

| | | | |
|---|---|---|---|
| 3,019,725 | 2/1962 | Freeman | 101/38 R |
| 3,351,388 | 11/1967 | Frank | 101/40 UX |
| 3,490,363 | 1/1970 | Derrickson | 101/38 R |
| 3,645,201 | 2/1972 | Jackson | 101/38 A |
| 3,682,296 | 8/1972 | Buhayer et al. | 101/40 X |
| 3,868,899 | 3/1975 | Nye et al. | 101/35 |

FOREIGN PATENT DOCUMENTS

| | | | |
|---|---|---|---|
| 1,276,946 | 6/1972 | United Kingdom | 101/38 R |

*Primary Examiner*—J. Reed Fisher
*Assistant Examiner*—R. E. Suter
*Attorney, Agent, or Firm*—Browdy and Neimark

[57] ABSTRACT

A machine for printing on thin-walled frusto-conical containers having little resistance to transverse deformation is provided with rotatable mandrels for holding and centering the containers during printing. Each mandrel has a rotatable body provided with two axially spaced centering rings adapted to engage the walls of the container and centralize the container relative to the axis of the mandrel upon axial movement of the container on to the mandrel. The centering rings make sealing engagement with the walls of the container and subdivide the space enclosed between the container and the mandrel body into an end chamber between the base of the container and the outer end of the mandrel, and an annular chamber between the side wall of the container and the mandrel body. The mandrel body is provided with suction conduit means for extracting air from the end chamber so as to hold the container on the mandrel with the centering rings in sealing engagement with the container walls, and the mandrel body is also provided with pressure conduit means for supplying compressed air to the annular chamber to support the side wall of the container against transverse deformation during a printing operation.

9 Claims, 6 Drawing Figures

MANDRELS FOR SUPPORTING CONTAINERS WITH NEGATIVE AND POSITIVE AIR PRESSURE

Figure 1:
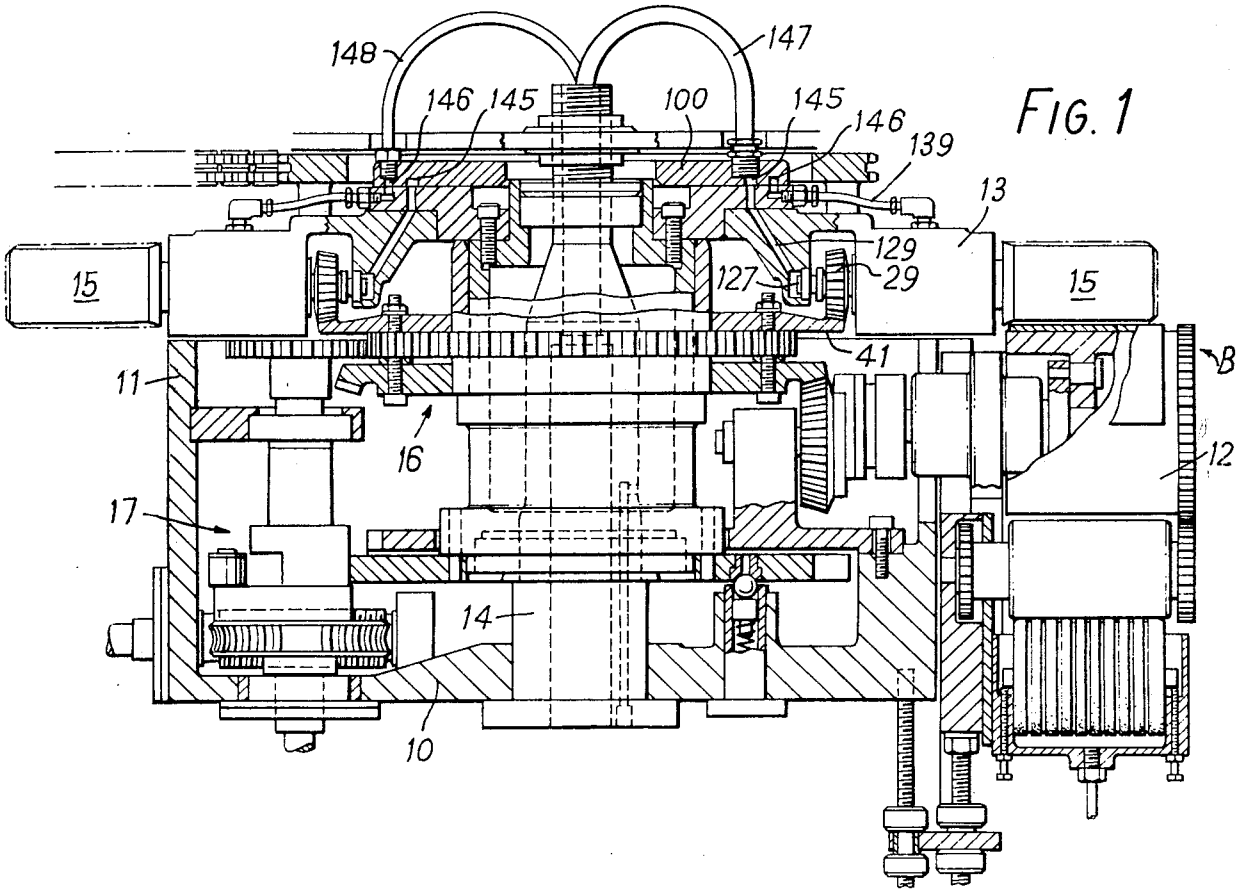

This invention relates to mandrels for supporting opentopped containers of circular cross-section, for example cylindrical or frusto-conical containers, and is concerned more particularly, but not exclusively, to mandrels suitable for use in a multi-cylinder printing machine as described and illustrated in British patent specification No. 1,316,272.

In the printing of containers mounted on rotary mandrels, it is essential for satisfactory results that the containers be accurately centered relative to the rotational axis of the mandrel, since otherwise the pressure between the printing plate and the container would vary during rotation of the mandrel. Various constructions of expandable mandrels comprising collars slidable along tapered cores have been proposed for holding and centering containers in printing machines, but such mandrels are not suitable for use with thin walled containers having little resistance to transverse deformation, since the pressure between the printing plate and a part of the container supported by a collar of the mandrel tends to be greater than the pressure between the printing plate and a part of the container not so supported.

According to the present invention there is provided a mandrel for holding and centering an open-topped container of circular cross section, comprising a rotatable body having an outer end which is adapted to extend into the interior of the container through the open top thereof, two axially spaced centering rings secured to or integral with said body, the two rings being adapted to engage the walls of the container and centralize the container relative to the axis of the mandrel upon axial movement of the container on the mandrel towards the inner end thereof, and said rings subdividing the space enclosed between the container and the mandrel body therein into an end chamber between the outer end of the mandrel and the base of the container and an annular chamber between the mandrel body and the side wall of the container, suction conduit means for extracting air from said end chamber, and pressure conduit means for supplying air or other fluid under pressure to said annular chamber whereby, in operation, the difference between the pressure in the end chamber and atmospheric pressure exerts a force on the base of the container holding the container against the centering rings, and the pressure of the fluid in the annular chamber supports the part of the container wall between the centering rings.

The mandrel of the invention is particularly suitable for use in printing on thin-walled containers in multi-cylinder printing machines since the pressure of air in the annular chamber ensures substantialy even contact between the printing cylinders and the part of the container supported by the air pressure, despite any small irregularities in the shape of the container or in the printing cylinders.

Moreoever, the mandrel of the invention can be of simple construction and light in weight so that a turret of a printing machine holding a plurality of mandrels can be indexed at greater speed, resulting in a higher output of the machine, than would be the case of the turret were fitted with mandrels of heavier construction.

Figure 2:
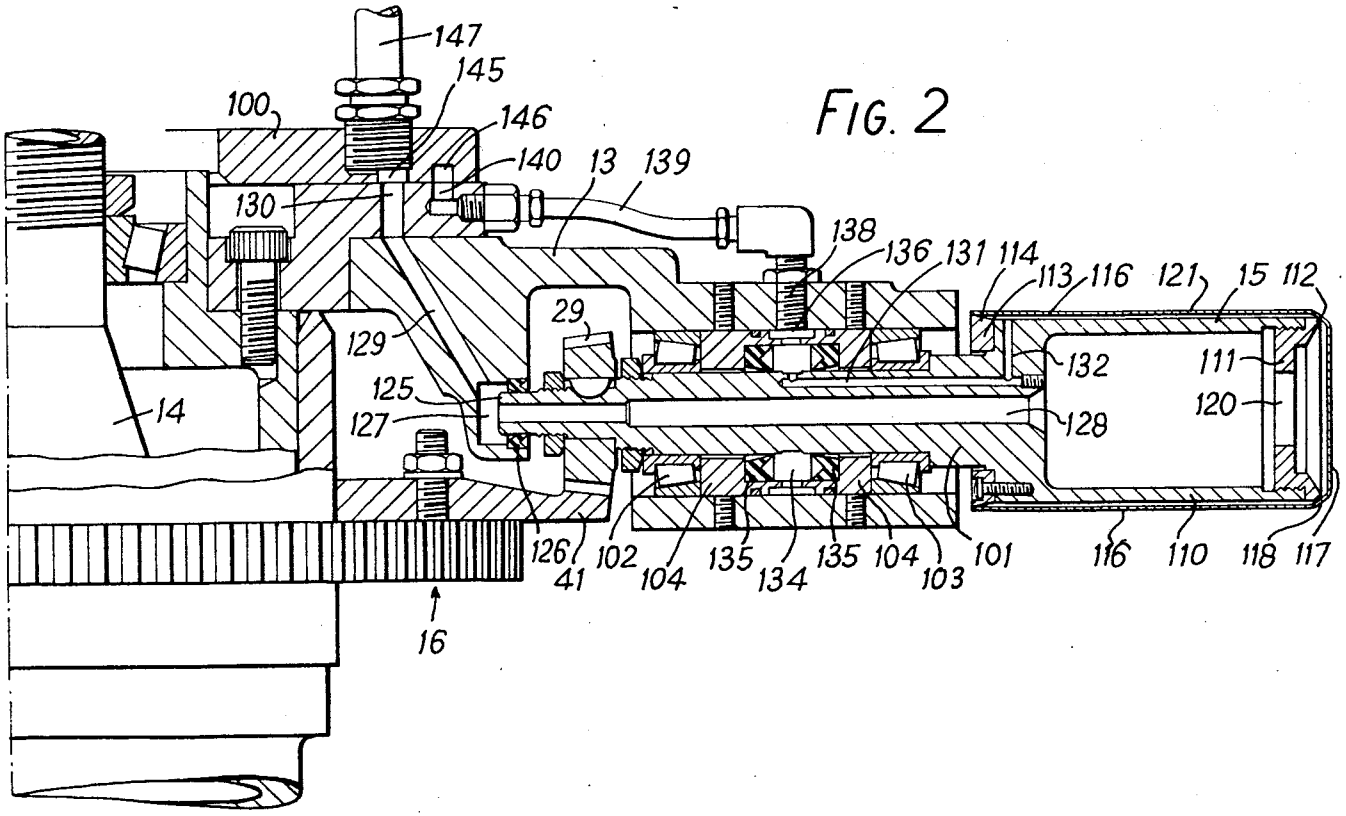
Figure 3:
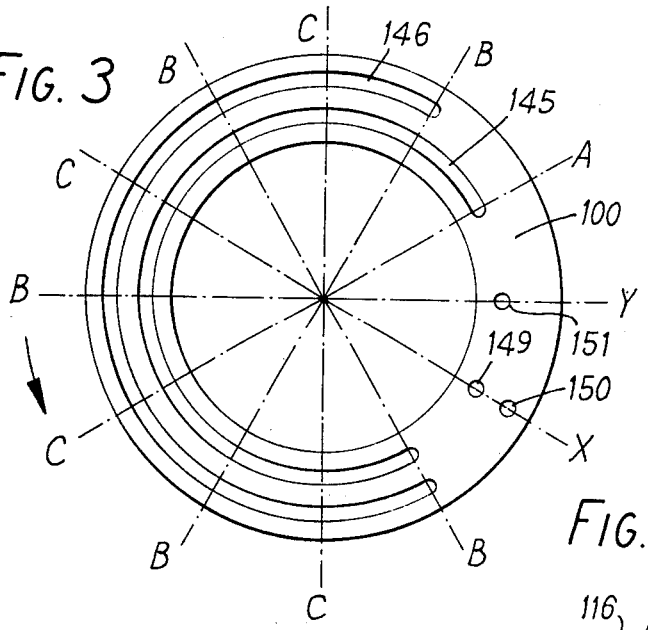
Figure 4:
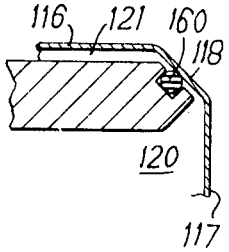
Figure 5:
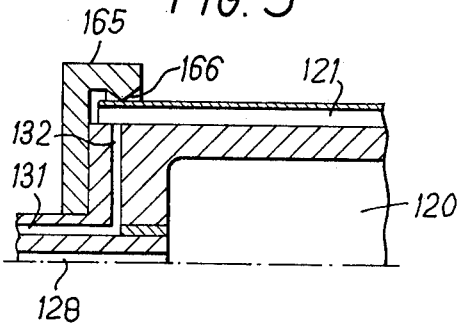
Figure 6:
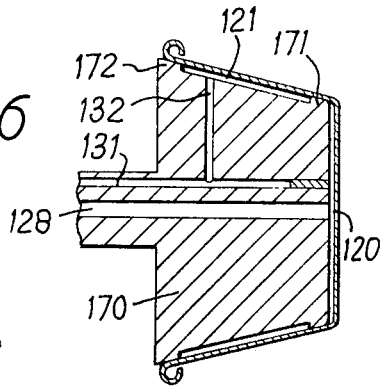

Embodiments of the invention will now be described, by way of example, with reference to the accompanying drawings, in which:

FIG. 1 is a sectional elevation view of a multi-cylinder flexographic printing machine fitted with mandrels for supporting cylindrical containers in accordance with the invention, FIG. 2 is a sectional elevation view, on a larger scale, of part of the machine of FIG. 1, showing one of the mandrels and its supporting and drive mechanism, FIG. 3 is a plan view of an air distribution ring which controls the supply of air under pressure and the application of vacuum to conduits in the mandrels on the turret in accordance with rotation of the turret, FIG. 4 is a detail view of a modified construction of centering ring between the mandrel and the closed end of a container on the mandrel, FIG. 5 is a detail view of a modified construction of centering ring between the mandrel and the open end of a container on the mandrel, and FIG. 6 illustrates a mandrel according to the invention suitable for use with a frusto-conical container shown mounted in position on the mandrel.

The multi-cylinder flexographic printing machine shown in FIG. 1 is substantially the same as the printing machine shown and described in British patent specification No. 1,316,272 except that the turret is fitted with mandrels in accordance with the present invention. A brief description of the construction and operation of the printing machine is given hereinfter to facilitate understanding of the operation of the mandrels illustrated in the drawings, but the same reference numerals have been used to identify similar parts of the two printing machines and reference may be made to British patent specification No. 1,316,272 for a fuller description of the parts of the machine not connected with the mandrels.

Referring now to the drawings of the pesent application, the machine shown in FIG. 1 comprises a base 10 having a peripheral wall 11, several printing cylinders 12 mounted one at each of separate printing stations B spaced apart around the outside of the wall 11, a turret 13 rotatably mounted on a vertical spindle 14 on the base 10, the turret having a plurality of mandrels 15 spaced at equal angular intervals around the periphery of the turrret, a master gear unit 16 rotatably mounted on the turret and adapted to rotate the printing cylinders 12 and mandrels 15 in synchronism, and a Geneva indexing mechanism 17 operable to index the turret in one direction or rotation to register each mandrel in turn at a loading station A (FIG. 3), each of the above mentioned printing stations B, each of several drying stations C disposed one between each adjcent pair of printing stations, a final drying station X, and then at an unloading station Y. The containers to be printed are mounted on the mandrels. An air distribution ring 100 fixed to the frame of the machine controls supply of air under pressure and the application of vacuum to conduits leading to the mandrels to hold and support containers mounted on the mandrels in accordance with rotation of the turret as hereinafter described.

As shown in FIG. 2, each mandrel 15 is fitted on the outer end of a spindle 101 rotatably mounted in the turret 13 by bearings 102, 103 spaced apart by two annular spacers 104, the axis of the spindle being radial relative to the rotational axis of the turret. The inner end portion of the spindle is fitted with a bevel gear 29 which meshes with a bevel gear 41 forming part of the master gear unit 16 rotatably mounted on the turret, whereby rotation of gear 41 rotates all the spindles 101 and mandrels 15 in synchronism.

Each mandrel 15 comprises a tubular cylindrical body 110 secured to the outer end of the associated spindle 101, the tubular body 110 being open at its outer end, a centering ring 111 fitted in the outer end of the body and forming a frusto-conical seat 112 on the outer end of the mandrel, and a further centering ring 113 secured to the inner end of the body 110 and forming a frusto-conical shoulder 114 larger in diameter than the body 110, the taper on the frusto-conical seat and the frusto-conical shoulder being in the radial outwards direction. The container shown on the mandrel in FIG. 2 has a cylindrical wall 116, a circular base 117, and a frusto-conical wall 118 forming the junction between the wall 116 and base 117, the container being of a size such that its cylindrical wall 116 is a loose fit on the body 110 of the mandrel, its frusto-conical wall 118 engages flat against the frusto-conical seat 112 on the mandrel, and the mouth of the container engages on the frusto-conical shoulder 114 on the mandrel. The centering rings 111, 113 thus centering the container on the axis of the mandrel and moreoever the seat 112 and shoulder 114 on these rings make sealing engagement with the container so that the space between the mandrel and the container is subdivided by the centering rings into two chambers, namely an end chamber 120 between the base 117 of the container and the body 110 of the mandrel and an annular chamber 121 between the cylindrical wall 116 of the container and the body 110 of the mandrel.

Each of the spindles 101 supporting the mandrels has its inner end formed with a nipple 125 which extends through an air seal 126 into a separate chamber 127 in the turret, and an axial duct 128 in the spindle connects the chamber 127 with the chamber 120 formed between the mandrel and the base of a container thereon. An air duct 129 in the turret connects the chamber 127 to a port 130 in the wall of the turret which mates with the stationary air distribution ring 100.

Each spindle 101 is also formed with a further axial duct 131, the outer end of which is connected by a transverse duct 132 to the annular chamber 121 formed between the mandrel and a container thereon, and the inner end of which is connected by a transverse duct to the annular cavity 134 formed between rotating air seals 135 fitted to the annular spacers 104 for the bearings 102, 103. The cavity 134 is connected by a duct 136 in the spacers 104 and by a duct 138 in the turret to a pipe 139 which leads to a port 140 in the wall of the turret which mates with the stationary air distribution ring 100.

The stationary air distribution ring 100 (FIG. 3) is formed with an arcuate groove 145 which registers with each of the ports 130 in the turret during movement of the associated mandrel from the loading station A to the final printing station B, and the ring 100 is also formed with a further arcuate groove 146 which registers with each of the ports 140 in the turret during movement of the associated mandrel from the first printing station B to the final printing station B. The groove 145 is connected by a pipe 147 to a source of vacuum and the groove 146 is connected by a pipe 148 to a source of air under pressure. The ring 100 is also provided with two ports 149, 150 connected to atmosphere and arranged to register with each pair of ports 130, 140 respectively in the turret when the mandrel associated with these ports is at the final drying station X. A further port 151 in the ring 100 is connected to a timed supply of compressed air and arranged to register with each port 130 in the turret when the associated mandrel is at the unloading station Y.

The operation of the printing machine is as follows:

A container is placed loosely on each mandrel 15 when the mandrel is indexed at the loading station A (FIG. 3) and at this position the arcuate groove 145 in ring 100 is in register with port 130 and a vacuum is being drawn through the pipe 147. The vacuum in ducts 129, 128 and chamber 120 then draws the container onto the mandrel until a seal is formed between the frusto-conical seat 112 on the centering ring 111 and the frusto-conical wall 118 at the base of the container. In this position the open end of the container engages the conical shoulder 114 on the mandrel to close off the annular chamber 121.

When the turret turns to index the mandrel and container at the first printing station B the port 140 comes into register with the arcuate groove 146 so that compressed air is supplied through the pipe 139 and ducts 131, 132 to the annular chamber 121. The air under pressure in the annular chamber 121 supports the wall of the container during printing at the various printing stations.

The difference between the high air pressure in the annular chamber 121 and atmospheric pressure exerts a force on the container tending to move the container radially outwards on the mandrel, and the difference between the vacuum pressure in chamber 120 and atmospheric pressure exerts a counter force on the container tending to move the container radially inwards on the mandrel. The cross sectional area of chamber 120 is however considerably greater than the cross sectional area of chamber 121, so that the force due to the vacuum in chamber 120 is considerably greater than the force due to the compressed air in chamber 121 and the container is thus held securely on the mandrel.

When the mandrel container are indexed into the final drying station X, the associated ports 130, 140 in the turret are in register with ports 149, 150 connected to atmosphere so that the vacuum in chamber 120 is relieved and the pressure in the annular chamber 121 is released. At the unloading station Y port 130 is in register with the port 151 in the ring 100 and a timed blast of compressed air from port 151 enters the chamber 120 and ejects the container from the mandrel at the appropriate instant in the machine cycle.

As shown in FIG. 4, the centering ring on the outer end of the mandrel may comprise a resilient sealing ring 160 of rubber or rubber-like material mounted in an annular groove in a frusto-conical end wall of the mandrel, the ring 160 being arranged to engage the frusto-conical wall 118 around the base of the container.

As shown in FIG. 5, the centering ring on the inner end of the mandrel may comprise a collar 165 secured to an inner end wall of the mandrel, the collar having an internally projecting annular ridge 166 adapted to engage the outside of a container mounted on the body of the mandrel. This construction has the advantage that the wall of the container is forced against the ridge 166 upon expansion of the container under the influence of fluid pressure in the annular chamber 121 formed between the mandrel and the container, thereby increasing the effectiveness of the seal between the ridge 166 and the container.

The mandrel shown in FIG. 6 for use with frusto-conical containers comprises a frusto-conical body 170 formed at its ends with raised frusto-conical shoulders 171, 172 adapted to mate with the internal surfaces of the container and thereby center the container on the mandrel, the space enclosed between the frusto-conical wall of the container and the two shoulders forming the annular chamber 121 to be supplied with fluid under pressure to support the wall of the container in accordance with the invention, and the space enclosed between the base of the container and the outer end wall of the mandrel forming the chamber 120 to be evacuated to hold the container on the mandrel.

Containers for use with the mandrels of the invention need not necessarily have straight walls as shown in the drawings. For example, the open ends of the containers may be necked, that is the internal diameter of the open end may be less than the internal diameter of the remainder of the container, or the base of the container may be concave as viewed from outside the container.

What is claimed is:

1. A rotary mandrel for holding and centering a container having a base, a side wall which is circular in cross-section and an open top at the end of the side wall remote from the base, said mandrel comprising a body having an inner end thereof mounted on a support and an outer end insertable into the interior of the container through the open top thereof, the mandrel body being rotatable about the longitudinal axis of the mandrel body and having two axially spaced centering rings on the periphery thereof co-axial with said rotational axis, said centering rings being engageable with the side wall of the container to centralize the container with respect to said rotational axis upon axial movement of the container on the mandrel body towards the inner end thereof, and said rings subdividing the space enclosed between the container and the mandrel body therein into an end chamber between the mandrel body and the base of the container and an annular chamber between the mandrel body and the side wall of the container, said end chamber being pneumatically sealed from said annular chamber when said centering rings engage a side wall of a container fitted on the mandrel, first conduit means in the mandrel body for extracting air from said end chamber, and second conduit means in the mandrel body for supplying fluid under pressure to said annular chamber whereby, in operation, the difference between the pressure in the end chamber and atmospheric pressure exerts a force on the base of the container holding the container on the mandrel, and the pressure of the fluid in the annular chamber supports the part of the container side wall between the centering rings.

2. A mandrel as claimed in claim 1 and suitable for holding and centering a container having a cylindrical side wall formed with a frusto-conical part adjacent the base of the container, wherein the centering ring adjacent the outer end of the mandrel body has a frusto-conical surface engageable with said frusto-conical part of the container.

3. A mandrel as claimed in claim 1 and suitable for holding and centering a container having a cylindrical side wall formed with a frusto-conical part adjacent the base of the container, wherein the centering ring adjacent the outer end of the mandrel body is resilient and engageable with said frusto-conical part of the container.

4. A mandrel as claimed in claim 1, wherein the centering ring adjacent the inner end of the mandrel body has a frusto-conical surface engageable with the inside of the open top of the container.

5. A mandrel as claimed in claim 1 and suitable for holding and centering a frusto-conical container, wherein the mandrel body is frusto-conical and formed integrally on the periphery thereof with raised frusto-conical shoulders constituting said centering rings.

6. A mandrel as claimed in claim 1, wherein the centering ring adjacent the inner end of the mandrel comprises a collar spaced from the body of the mandrel, the inner periphery of said collar having an annular ridge larger in diameter than the mandrel body, engageable with the outside of the side wall of the container when mounted on the body of the mandrel.

7. A multi-cylinder printing machine for printing on containers of a standard size each having a base, a side wall which is circular in cross-section and an open top at the end of the side wall remote from the base, said printing machine comprising a frame, a turret rotatably mounted on the frame, and a plurality of rotary mandrels mounted on the turret and adapted to hold said containers, said frame having a plurality of stations disposed around the turret, said stations including a container loading station, a container unloading station, and printing stations between the container loading and unloading stations in the circumferential direction of the turret, and said turret being angularly movable to index each mandrel in succession to each of said stations, wherein each of said mandrels comprises a support member on said turret, a mandrel body mounted on said support member for rotation about the longitudinal axis of the mandrel body, said mandrel body having an outer end insertable into the interior of one of said containers through the open top thereof and having two axially spaced centering rings on the periphery of the mandrel body co-axial with said longitudinal axis, said centering rings being engageable with the side wall of the container to centralize the container with respect to said longitudinal axis upon axial movement of the container on the mandrel body towards its support member, and said rings sub-dividing the space enclosed between the container and the mandrel body therein into an end chamber between the mandrel body and the base of the container and an annular chamber between the mandrel body and the side wall of the container, said end chamber being pneumatically sealed from said annular chamber when said centering rings engage a side wall of a container fitted on the mandrel, first conduit means in the mandrel body for extracting air from said end chamber, and second conduit means in the mandrel body for supplying fluid under pressure to said annular chamber, and wherein said frame includes a vacuum conduit connectable to a source of vacuum, a pressure conduit connectable to a source of fluid under pressure, and distribution means operable upon rotation of the turret to connect said first conduit means of each mandrel to said vacuum conduit during passage of said each mandrel through the loading station and printing stations and to connect said second conduit means of each mandrel to said pressure conduit during passage of said each mandrel through the printing stations, whereby, during passage of said each mandrel through the printing stations, the difference between the pressure in the end chamber and atmospheric pressure exerts a force on the base of the container holding the container on the mandrel, and the pressure of fluid in the annular chamber supports the part of the container side wall between the centering rings.

8. A multi-cylinder printing machine as claimed in claim 7, wherein said distribution means includes ports connected to atmosphere, and said distribution means are further operable to connect the first and second conduit means of each mandrel to said ports immediately prior to indexing of said each mandrel to the unloading station.

9. A multi-cylinder printing machine as claimed in claim 7, wherein said distribution means includes a further port connectable to means for supplying a blast of compressed air upon indexing of each mandrel to the unloading station, and said distribution means are further operable to connect the first conduit means of each mandrel to said further port upon indexing of the said each mandrel to the unloading station, whereby in operation said blast of compressed air enters the end chamber of each mandrel indexed to the unloading station and thereby ejects the container from the mandrel.

* * * * *